United States Patent [19]

Ozaki

[11] 4,098,056

[45] Jul. 4, 1978

[54] COIN PASSAGE DEVICE OF A COIN PROCESSING MACHINE

[75] Inventor: Ichiro Ozaki, Himeji, Japan

[73] Assignee: Glory Kogyo Kabushiki Kaisha, Himeji, Japan

[21] Appl. No.: 715,646

[22] Filed: Aug. 18, 1976

[30] Foreign Application Priority Data

Aug. 22, 1975 [JP] Japan ..... 50/101795

[51] Int. Cl.[2] ..... B65B 11/04

[52] U.S. Cl. ..... 53/212

[58] Field of Search ..... 53/212; 198/735, 836; 133/1 R; 194/1 K; 74/55, 422, 567

[56] References Cited

U.S. PATENT DOCUMENTS

| | | | |
|---|---|---|---|
| 635,177 | 10/1899 | McCabe | 198/836 X |
| 848,736 | 4/1907 | Glass | 198/735 |
| 887,442 | 5/1908 | Tatum | 74/567 |
| 2,156,020 | 4/1939 | Lathrop | 198/836 |
| 2,229,605 | 1/1941 | Snyder et al. | 198/836 |
| 3,021,587 | 2/1962 | Rudbarg | 74/55 |
| 3,094,007 | 6/1963 | Luhrs | 74/422 |
| 3,170,333 | 2/1965 | Umbricht | 74/567 X |
| 3,818,771 | 6/1974 | Kobelt | 74/567 X |
| 3,938,303 | 2/1976 | Ushio et al. | 53/212 |

FOREIGN PATENT DOCUMENTS

| | | | |
|---|---|---|---|
| 2,124,649 | 12/1971 | Fed. Rep. of Germany | 194/1 K |

*Primary Examiner*—Othell M. Simpson
*Assistant Examiner*—John Sipos

[57] ABSTRACT

A coin passage device of a coin wrapping machine comprises two perimeter edge plates defining opposite side walls of a coin passage and adapted to be adjustably movable toward and away from each other by equal distances thereby to adjust symmetrically the transverse width of the coin passage without shifting the centerline thereof, a position adjusting mechanism actuated by a cam to thus adjust the perimeter edge plates to any one of a plurality of predetermined widths which are respectively suited for different kinds of coins which can be processed in the machine, and a coin propelling mechanism for propelling coins along the coin passage by propelling force acting always on the centers of all coins, irrespective of the diameters thereof, as a result of the symmetrical adjustment of the coin passage width.

3 Claims, 12 Drawing Figures

COIN PASSAGE DEVICE OF A COIN PROCESSING MACHINE

BACKGROUND OF THE INVENTION

This invention relates generally to coin handling and processing machines and more particularly to a coin passage device in machines such as coin counting machines and coin packaging machines, which device operates to sort out coins of any one kind selected from a number of different kinds of coins and to propel the sorted coins along a coin passage.

In a coin passage device of this character known heretofore, a pair of perimeter members defining the lateral perimeters of the coin passage are provided in mutually opposed positions on opposite sides of the coin passage, one of these members being stationary and the other being movable toward or away from the stationary member to adjust the width of the coin passage in accordance with the diameter of the coins to be processed. Accordingly, the lateral edges of each coin engage with the two perimeter members as the coin is propelled along the coin passage by an endless propelling belt. Inappropriate coins of diameters smaller than the proper diameter of the selected kind of coin are rejected from the space between the two perimeter members, and only the coins of the selected kind are sent along the coin passage to be counted, for example, by counting means such as a counting wheel or a photoelectric tube installed in the passage.

In a coin passage device of the above described construction, when there is a great difference between the smallest and largest diameters of the coins to be processed, the distance of adjusting movement of the movable perimeter member is large, and the propelling belt in some instances may press against the edge part of a coin on one side, offset from the center of the coin.

Furthermore, during the supplying of coins by action such as centrifugal force of a rotating turntable from a coin supply mechanism to the coin passage, the propelling belt is pushed upward and undergoes an up-and-down swinging motion. As a consequence, a previously supplied coin in the coin passage is caused to assume a state wherein its lateral edge on one side is in contact with the propelling belt, while the opposite lateral edge is lifted off the coin passage. As a result, this coin becomes superimposed on the preceding coin, whereby the processing such as sorting of the coins becomes inaccurate.

Furthermore, in a mechanical arrangement wherein only the perimeter member on one side is movable for adjustment, the centerline of the coins sent out from the coin passage and the center of a coin stacking mechanism, for example, which is provided downstream from the coin passage for stacking the coins do not always coincide. As a consequence, the flow of the coins becomes unstable, and the coins are not accurately stacked, whereby so-called "edge-on" piling readily occurs.

Still another problem which arises in the case where the stacking step precedes a coin packaging step are that, when the coins stacked in the stacking mechanism is introduced into the space between wrapping rolls of the coin packaging means, the center of the coin stacking mechanism and the center of a plurality of the wrapping rolls are different, and are positionally offset from each other. This tendency is particularly pronounced in a coin packaging machine for packing various kinds of coins with large differences in diameter. As a consequence, the stack of coins readily collapses during the transfer thereof from the stacking mechanism to the space between the wrapping rolls or at the time when the coin stack thus transferred is clamped between the wrapping rolls, whereby the packaging operation cannot be carried out accurately and positively. Moreover, the coins readily scatter and are therefore in an unstable stacked state.

In one type of known coin passage device, as described hereinafter, there are provided stationary and movable perimeter members as described above, the movable perimeter member being pressed against and actuated directly during adjustment by a polygonal cam fixed to a shaft which is manually rotatable. By this mechanical arrangement, the force of the perimeter member applied to the cam does not always pass through the axis of rotation of the cam, whereby the rotational adjustment position of the cam cannot be positively maintained and the cam may be forced out of this position if the above mentioned force is great.

SUMMARY OF THE INVENTION

It is an object of this invention to provide a coin passage device in coin handling and processing machines, in which device the above described problems are overcome.

More specifically, it is an object of this invention to provide, in a coin processing machine, a coin passage device in which a coin passage is formed at its lateral sides by two opposed perimeter members adapted to be adjustably moved in unison uniformly toward and away from each other thereby to cause coin propelling means such as an endless propelling belt to operate always with its centerline in vertical coincidence with the centerline of the passage and thereby to act on the coins always at their centers. By these features of the invention, positive and accurate sorting and counting of coins are afforded.

Another object of this invention is to provide, in a coin counting and packaging machine having a coin counting device, a coin stacking device, and a coin packaging device, the combination of the coin passage device of the invention with improvements in the coin stacking and packaging devices, by which combination the centerlines of all of these devices can be coincidently alined with the centerline of the coin passage as a reference datum, whereby coin packaging can be accomplished positively and accurately.

Still another object of the invention is to provide a coin passage device of the above stated character in which the width of the coin passage is adjusted by a mechanism including an adjusting cam affording accurate positioning and positive holding of the mechanism in each adjustment position.

According to this invention in a basic aspect thereof, briefly summarized, there is provided a coin passage device of a coin processing machine, which device comprises: first and second side perimeter edge members defining opposite side walls of a coin passage and adapted to be adjustably movable toward and away from each other by equal distances thereby to adjust symmetrically the transverse width of the coin passage without shifting the centerline thereof to predetermined adjustment widths which are respectively slightly greater than the diameters of respective different kinds of coins which can be processed in the machine; position adjusting means operable to thus move the first and second side perimeter edge members; and coin propelling means acting on coins in the coin passage to propel the coins therealong, the coin propelling means always acting on the centers of all coins, irrespective of the diameters thereof, as a result of the symmetrical adjustment of the coin passage width.

According to this invention in another aspect thereof, briefly summarized, there is provided a coin passage device of a coin counting and packaging machine, the coin passage device being in combination with coin counting means provided at the downstream end of the coin passage and operating to count coins which have passed through the coin passage; a coin stacking device operating to stack the coins thus counted into neat stacks each of a predetermined number of coins and being accommodatively adjustable precisely to the diameter of the kind of coin being processed without shifting of the position of the stack center; and a coin packaging device operating to package each coin stack thus stacked by wrapping the stack with a wrapping sheet material by means principally of a plurality of wrapping rolls surrounding the stack and adapted to be accommodatively adjustable precisely to the diameter of the kind of coin being packaged without shifting of the position of the center of the space between the rolls.

According to this invention in a further aspect thereof, briefly summarized, there is provided a coin passage device of the above described character in which the position adjusting means for adjusting the positions of the perimeter edge members has: a roller rotatably supported on one of the perimeter edge members; a cam plate having a center of rotation and provided around the peripheral part thereof with a plurality of concavely arcuate recesses each engageable with the roller, the distances respectively between the bottoms of these recesses and the cam center of rotation being respectively different and of magnitudes to accommodatively adjust the coin passage width to respective kinds of coins; cam rotating means for rotating the cam plate for adjustment for another kind of coin; and elastic means for urging the roller toward and against the cam plate.

The nature, utility, and further features of this invention will be apparent from the following detailed description with respect to preferred embodiments of the invention when read in conjunction with the accompanying drawings briefly described below, throughout which like parts are designated by like reference numerals.

DETAILED DESCRIPTION

Figure 1:
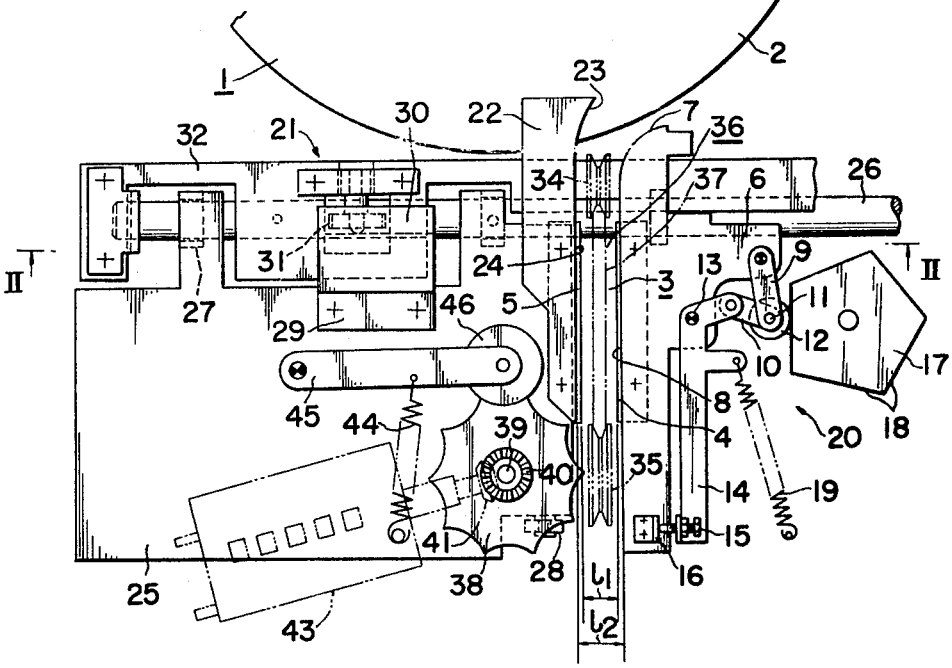
FIG. 1 is a plan view showing one example of a coin passage device of a coin processing machine illustrating one embodiment of this invention.
Figure 2:
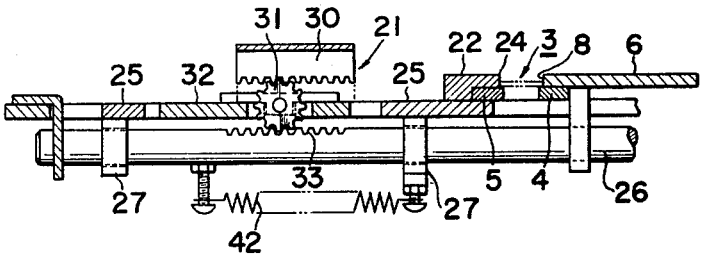
FIG. 2 is an elevation, partly in vertical section, of one part of the coin passage device shown in FIG. 1.

Referring first to FIGS. 1 and 2, the coin passage device of this invention is installed, for example, so as to adjoin coin supply means 1 comprising a rotating turntable 2 and coin guide means (not shown) formed around the peripheral edge of the turntable. Coins dropped onto the turntable 2 are moved outward by centrifugal force toward the periphery of the turntable and are then moved along the coin guide means without superimposition of one coin on another in the space between the coin guide means and the turntable.

The coin passage device has a coin passage 3 defined at its lateral sides by a pair of first and second perimeter members 4 and 5. These perimeter members 4 and 5 are disposed in mutually opposed positions and are adapted to be movable toward or away from each other. On the upper side of the first perimeter member 4, a perimeter edge member 6 is fixed thereto. This perimeter edge member 6 has at its upstream part an induction edge 7 of convex arcuate shape for inducting coins on the aforementioned turntable 2 into the coin passage 3 and a perimeter edge 8 contiguously joining the downstream end of the induction edge and extending downstream on one side of the coin passage.

The position of the first perimeter member 4 relative to the centerline of the coin passage 3 is adjustable by an adjusting mechanism 20 comprising the first perimeter edge member 6, first and second links 9 and 10, a coin passage width adjusting lever 14, a cam follower roller 12, and a polygonal adjusting cam 17 as described below.

The first link 9 is pivotally connected at its one end to a part remote from the coin passage 3 of the first perimeter edge member 6 and is pivotally connected at its other end to one end of the second link 10 by a shaft 11 rotatably supporting the cam follower roller 12. The other end of the second link 10 is pin connected to the outer end of an arm of the coin passage width adjusting lever 14, which is pivotally connected by a pin 13 to the first perimeter edge member 6. The lever 14 has another arm, at the end of which is provided an adjusting screw 15 screw engaged with a flange fixed to that arm. The screw 15 is substantially perpendicular to the above mentioned arm and is adapted to abut at its one end against an engagement member 16 fixed to the first perimeter edge member 6.

The above mentioned cam follower roller 12 is adapted to follow the cam edge 18 of a polygonal cam 17, which is rotatable to adjust the width ($1_1$) of the coin passage 3 to the diameter of the coins of the kind to be passed therethrough. The roller 12 is continually urged toward the cam edge 18 by a tension spring 19 stretched between a part of the lever 14 and a part of the device frame.

The position of the second perimeter member 5 can be adjusted by an adjusting mechanism 21 of the following construction. A second perimeter edge member 22 is fixed to the upper face of the second perimeter member 5 and has at its upstream end an induction edge 23 of concave arcuate shape for inducting coins on the aforementioned turntable 2 into the coin passage 3. The second perimeter edge member 22 further has a perimeter edge 24 contiguously joined to the downstream end of the induction edge 23 and extending downstream along a lateral side of the coin passage 3. The second perimeter member 5 and the second perimeter edge member 22 are fixed onto the upper face of a horizontal travel guide base plate 25.

This base plate 25 is provided at its rear end part near the turntable 2 with a guide part 27 for slidably guiding a horizontal sliding actuating bar 26 fixed to the above mentioned perimeter edge member 6 and at its front end part remote from the turntable 2 with a roller 28 adapted to roll along a horizontal track (not shown) substantially perpendicular to the coin passage 3. Furthermore, on the rear end part of this base plate 25, a horizontal rack structure 30 is mounted on a support member 29 fixed to the base plate 25. A pinion 31 positioned below and meshed with the rack structure 29 is rotatably supported by a horizontal stationary plate 32. The pinion 31 is meshed also at its lower part with rack teeth 33 formed on the upper part of the above mentioned actuating bar 26.

Above the coin passage 3, there is provided coin propelling means 36 comprising an endless propelling belt 37 and rotatably supported pulleys 34 and 35 around which the belt 37 is passed and thus suspended over and along the coin passage 3 in alinement with the centerline thereof. One of the pulleys 34 and 35, preferably the pulley 35, is driven by an electric motor (not shown). The lower span of the belt 37 is adapted to press down on and propel coins in sliding travel along the coin passage in the manner known in the art.

The counting wheel 38 of counting means is rotatably supported on the base plate 25 on one side of the coin passage 3 at the downstream end thereof. This counting wheel 38 is so disposed that, as each coin traveling along the passage 3 engages with and then disengages from the counting wheel, the wheel is rotated through a specific angle. The counting wheel 38 is fixed to a rotatable shaft 39, by which the rotation of the counting wheel 38 is transmitted by way of this shaft 39 and bevel gears 40 and 41 to the input shaft of a counter 43. Excessive rotation due to momentum, for example, of the counting wheel 38 is prevented by a braking wheel 46 engageable with each of the arcuate concavities formed around the periphery of the counting wheel. The braking wheel 46 is rotatably supported on the distal end of a lever 45 pivoted at its proximal end on the base plate 25 and urged by a tension spring 44 to rotate in the direction to press the braking wheel 46 against the counting wheel 38. The braking wheel 46 serves also to position the counting wheel 38 in appropriate angular position for being engaged by and counting a succeeding coin.

A tension coil spring 42 is stretched between a part of the above mentioned stationary plate 32 and a part of the actuating bar 26 and functions to urge the actuating bar 26 continually in the direction to widen the coin passage 3.

The coin passage device of the general construction according to this invention operates in the following manner.

When the adjusting cam 17 is rotated and set in a desired rotational position, the cam follower roller 12 in rolling contact with this cam 17 is caused to undergo a movement which is transmitted by way of the links 9 and 8 and the lever 14 for adjusting the coin passage width to move the first perimeter edge member 6 toward or away from the second perimeter edge member 22.

As a consequence of this movement of the first perimeter edge member 6, the actuating bar 26 fixed thereto is caused to move in the same direction, whereby the pinion 31 meshed with the rack teeth 33 formed on the actuating bar 26 transmits this movement to the rack structure 30 meshed with the pinion 31, the rack structure 30 thereby being moved in the direction opposite to the direction of movement of the actuating bar 26. Consequently, the second perimeter edge member 22 is moved toward or away from the first perimeter edge member 6 a distance uniformly equal to that of the first perimeter edge member 6.

In this manner, the width distance ($l_2$) between the two perimeter edge members 6 and 22 is set slightly greater than the diameter of the coins to be counted, while the width distance ($l_1$) between the two perimeter members 4 and 5 is set slightly less than the diameter of the coins.

With the device in this state, the turntable 2 is rotated by an electric motor (not shown), whereupon the coins on the turntable are caused by centrifugal force to slide to the periphery of the turntable and hence into the space between the coin induction edges 7 and 23 of the two perimeter edge members 6 and 22. The coins then slide along a guide plate (not shown) and are propelled by the aforementioned propelling belt 37 to travel on and along the two perimeter members 4 and 5. Coins of kinds having diameters smaller than the coins to be counted drop through the gap ($l_1$) between the two perimeter members 4 and 5 and are thus removed, and only coins of the proper diameter pass through the coin passage 3 to the counting wheel 38.

Furthermore, since the counting wheel 38 confronting this coin passage 3 is provided on the base plate 25, it moves unitarily with the second perimeter edge member 22, and the position of the counting wheel 38 relative to the second perimeter edge member 22 is always the same, being unrelated to the width of the coin passage 3. Each coin rotates the counting wheel 38 through a specific angle as it slides on and along a guide plate (not shown) provided at the downstream end of the second perimeter member 5 thereby to actuate the counter 43 and cause it to count the coin.

Thus, the means for adjusting the positions of the two perimeter members 4 and 5 in the above described example of the coin passage device of this invention has a construction wherein the adjusting mechanisms 20 and 21 for position adjustment of the first and second perimeter members are intercoupled through the enmeshed mechanism comprising the rack teeth 33 formed on the sliding actuating bar 26, the rack structure 30, and the pinion 31 interposed therebetween. This position adjusting means according to this invention is not limited to such construction, however, various other mechanical arrangements being suitable as illustrated below.

Figure 3:
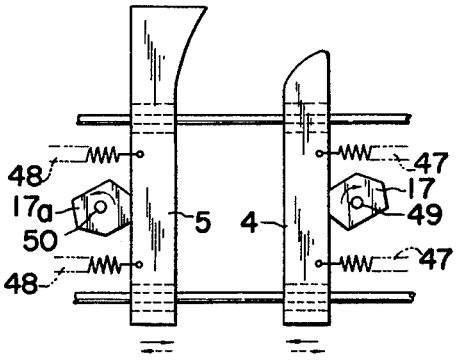
FIGS. 3, 4, and 5 are plan views respectively illustrating other examples of mechanisms for adjusting the positions of movable side perimeter edge members in the device of this invention.

In one other mechanism as shown in FIG. 3, the two perimeter members 4 and 5 are continually urged by tension, springs 47 and 48, respectively, to move apart in opposite directions but are restrained and held at specific adjustment positions by adjusting cams 17 and 17*a*, respectively, being pressed at their outer edges against the peripheral edges of the cams 17 and 17*a* by the forces of the springs 47 and 48. The cams 17 and 17*a* are respectively fixed to shafts 49 and 50, which are rotatable about fixed vertical axes and are intercoupled by suitable means such as a bevel gear mechanism to rotate in synchronism with each other. By this construction, the two perimeter members 4 and 5 can be moved uniformly in the lateral direction toward or away from each other.

Figure 4:
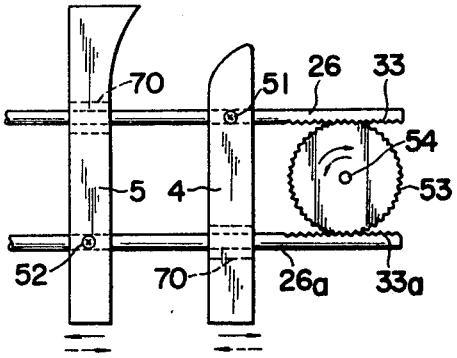

In still another mechanism as illustrated in FIG. 4 two actuating bars 26 and 26*a* are connected by connecting means 51 and 52 respectively to the first and second perimeter members 4 and 5 and are disposed parallel to each other and perpendicularly to the perimeter members 4 and 5, the actuating bar 26 being at a position nearer to the upstream end of the coin passage 3 than the actuating bar 26*a*. One end part of the actuating bar 26 extends slidably through a guide part 70 of the perimeter member 5, while the other end part of this bar 26 is provided with rack teeth 33. One part of the actuating bar 26*a* extends slidably through a guide part 70 of the perimeter bar 4, and the end part of this bar 26*a* is provided with rack teeth 33*a*.

A pinion 53 fixed to a rotating shaft 54 is interposed between and meshed with the rack teeth 33 and 33*a*. By rotating the shaft 54 of this pinion 53, the actuating bars 26 and 26*a* are moved in mutually opposite directions thereby to move the two perimeter members 4 and 5 uniformly in the mutually approaching or separating direction.

Figure 5:
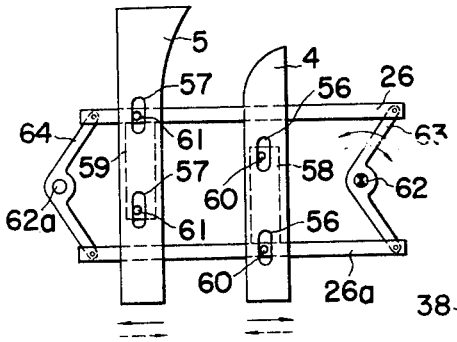

In a further example of the actuating mechanism as illustrated in FIG. 5, slots 56 and 57 are respectively formed in the longitudinal direction in the perimeter members 4 and 5 and are respectively engaged by pins 60 and 61 fixed to and projecting from intercoupling members 58 and 59. One end of the intercoupling member 58 is fixed to an actuating bar 26*a* disposed perpendicularly to the perimeter members 4 and 5, while one end of the intercoupling member 59 is fixed to another actuating bar 26 disposed parallel to and spaced from the bar 26*a*.

The parallel actuating bars 26 and 26*a* are pinconnected at their ends on one side to an intercoupling lever 63 and at their ends on the opposite side to an intercoupling lever 64. The levers 63 and 64 are rotatably supported at their middle points respectively by a turning shaft 62 and a pivot pin 62*a*, for example. By rotating the shaft 62, the actuating bars 26 and 26*a* are moved in parallel and in mutually opposite directions thereby to adjust the spacing between the perimeter members 4 and 5.

It should be understood, of course, that the means for adjusting the positions of the two perimeter members 4 and 5 is not limited to the constructions of the above described examples thereof. Furthermore, the counting means is not limited to that including the counting wheel 38 described above.

It is to be observed that in each of the above described examples of the coin passage device according to this invention, the centerline of the coin passage 3 is always maintained immovable, irrespective of the adjustment of the spacing of the two perimeter members 4 and 5, that is the width of the coin passage. Accordingly, the coins traveling through the coin passage are acted upon at their centers by the coin propelling means such as a propelling belt. Therefore, since rising of coins is prevented, there is no superimposition of coins, and coins can be caused to travel in orderly sequence along the coin passage for counting and any other subsequent processing.

Figure 6:
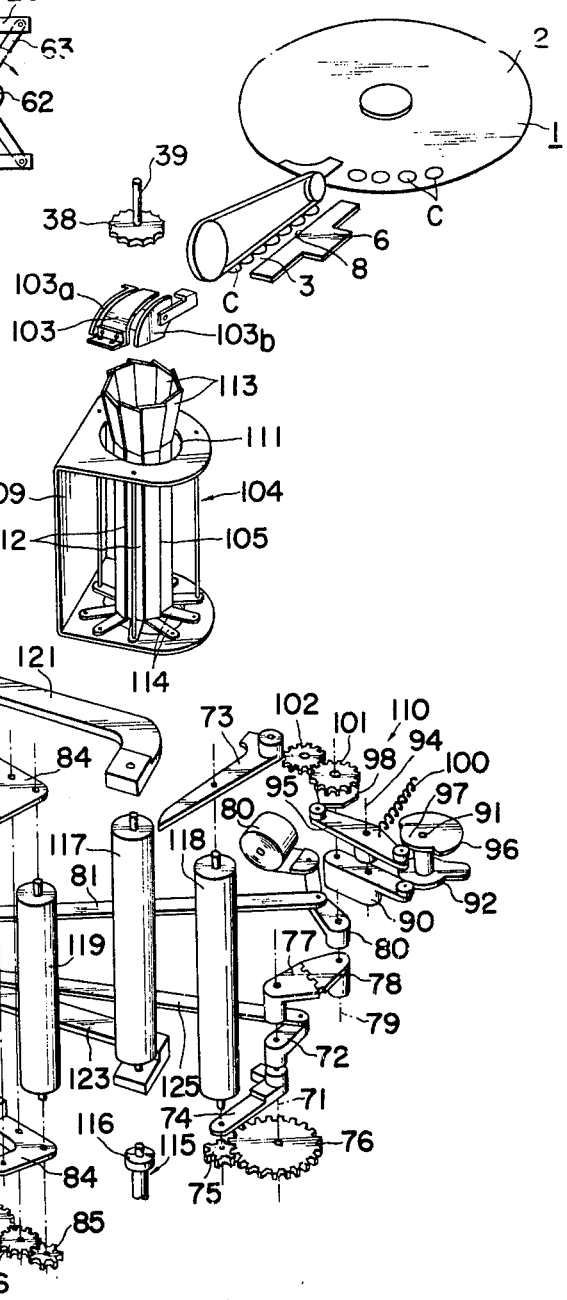
FIG. 6 is an exploded perspective view, with parts deleted for the sake of clarity, showing the essential parts of one example of the coin passage device of the invention in combination with a coin stacking device and a coin packaging device in a coin packaging machine.
Figure 7:
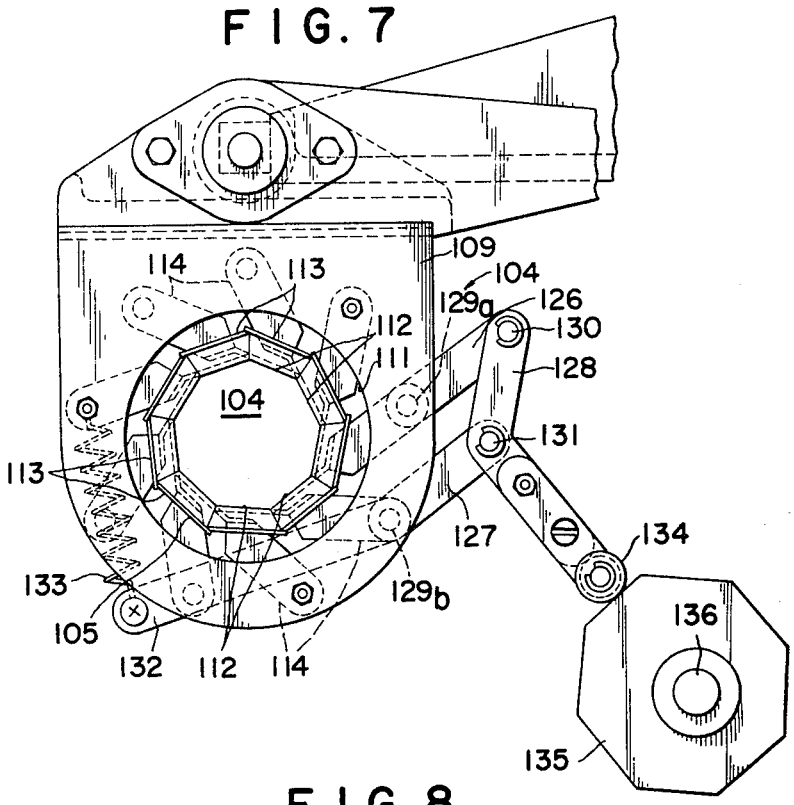
FIG. 7 is an enlarged plan view showing certain details of construction of the coin stacking device in the combination illustrated in FIG. 6.
Figure 8:
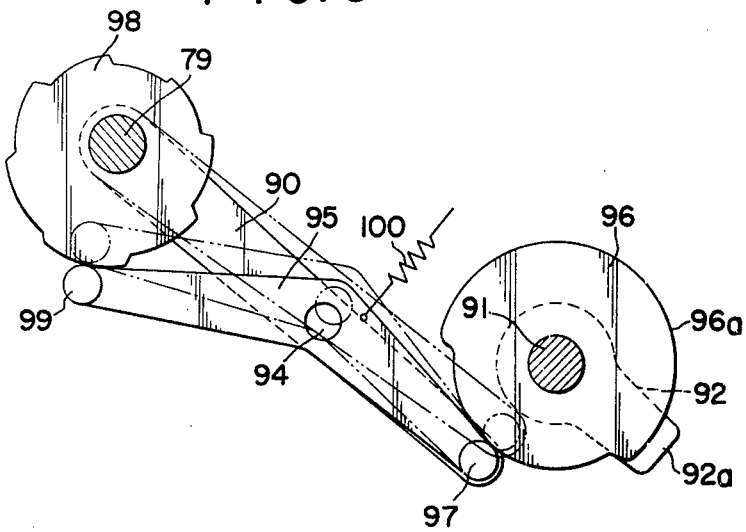
FIG. 8 is an enlarged plan view of a mechanism for adjustment of wrapping rolls in the coin packaging device shown in FIG. 6.

One example of advantageous application of the coin passage device of this invention in a coin processing machine will now be described with respect to a coin packaging machine, reference being made to FIGS. 6, 7, and 8. In this coin packaging machine, the coin passage device according to the invention, together with coin counting means, is incorporated in combination with a coin stacking device 104 and a coin packaging device 122 as shown in FIG. 6.

At the downstream end of the coin passage 3 of the coin passage device of the invention, there is provided a coin chute or coin guide structure 103, the centerline of which along the path of the coins registers with the centerline of the coin passage 3. The side walls of this coin guide structure 103 are formed by left and right side plates 103*b* and 103*a*, which are respectively fixed to the aforementioned travel guide base plate 25 and the first perimeter edge member 6. The distance between the inner surface of these side plates 103*a* and 103*b* is adjustably set to be slightly greater than the diameter of the coins of the kind to be processed. This coin guide structure 103 functions to guide coins C sent out from the coin passage 3 downward toward a coin stacking device 104 disposed below the coin guide structure 103 with coinciding centers.

This coin stacking device 104 has a central coin alinement tube 105 and a support frame 109 supporting the coin alinement tube 105 and having an upper flange with a hole 111 therethrough through which the upper part of tube 105 extends. The coin alinement tube 105 is made up of a plurality of individual slots 112 assembled in contiguous mutually overlapped arrangement around a circle, one lateral edge of each slot 112 being overlapped on the outer face of nearest lateral edge of the adjacent slot on one side, and the other lateral edge of the slat being overlapped on the inner face of the nearest lateral edge of the adjacent slat on the other side. The coin alinement tube 105 thus assembled is in the shape of a right prism approaching that of right cylinder.

The upper parts of these slats 112 are in the form of fans with a width progressively expanding upward and are bent obliquely outward from the tube centerline, thereby forming a funnel 113 for collecting and guiding coins dropped successively through the coin guide structure 103. Furthermore, the slats 112 are provided at their lower ends with respective arms 114 extending perpendicularly outward therefrom and pivotally connected at their outer ends on a lower flange of the support frame 109 at positions on a circle with a center through which the centerline of the tube 105 passes.

The inner diameter of the coin alinement tube 105 can be adjustably varied to suit the diameter of the kind of coin being processed by rotating the slats 112 in unison about their pivotal points on the lower flange of the support frame 109. This can be accomplished by a mechanism of the following description.

Parallel extension arms 126 and 127 are respectively fixed to the arms 114 of two slats 112 of the assembly of slats. These extension arms 126 and 127 are pin connected at their other (outer) ends to an adjusting lever 128. The pivotal points 129*a* and 129*b* of these arms 114 and the extension arms 126 and 127 and the pin joints 130 and 131 of the extension arms 126 and 127 and the adjusting lever 128 are at the corners of a parallelogram. The extension arm 127 has an extension 132 connected at its distal end to one end of a tension coil spring 133 anchored at its other end to the support frame 109. This coil spring 133 functions to impart a force urging the divisional slats 112 in their respective directions for constricting the inner diameter of the coin alinement tube 105.

Furthermore, the other end of the adjusting lever 128 rotatably supports a roller 134, which is in contact with and follows a polygonal cam 135 fixed to a rotating shaft 136. The distances from the centerline of this shaft 136 to the different peripheral cam surfaces of the cam 135 are such as to adjustably vary the inner diameter of the aforedescribed coin alinement tube 105 to suit the different kinds of coins to be processed. The shaft 136 is rotated by the turning of a setting shaft (not shown) thereby to set the cam 135 together with the aforedescribed cam 17 in accordance with the kind of coin to be packaged.

The coin packaging means 122 has first, second, and third wrapping rolls 117, 118, and 119, which are adapted to advance toward and retract from a central point as shown in FIG. 6 and are disposed below the above described coin alinement tube 105 with this central point substantially in alinement with the centerline of the tube 105.

The first wrapping roll 117 is rotatably supported at its upper and lower ends by the distal ends of arms 121 and 123, respectively, which are supported at their proximal ends on a vertical rotating shaft 120. An arm 124 also supported on this shaft 120 is rotatably pin connected at its distal end to one end of a link 125, which is rotatably pin connected at its other end to the distal end of a rotating arm 72 supported on a vertical rotating shaft 71. This shaft 71 at its upper and lower parts also supports rotating arms 73 and 74, which are coupled by a shaft (not shown).

These arms 73 and 74 rotatably support the upper and lower ends of the second wrapping roll 118. A gear 75 fixed to the lower end of this second wrapping roll 118 is meshed with a gear 76, which is rotatably supported on the above mentioned shaft 71. This shaft 71 further supports a sector gear 77 meshed with another sector gear 78, which is provided on a rotating shaft 79. A rotating arm 80 is fixed to the shaft 78 and is rotatably pin connected at its distal end to one end of a link 81, which is pin connected at its other end to the distal end of a rotating arm 83 provided on a rotating shaft 82.

Arms 84 are mounted on the upper end lower parts of the rotating shaft 82 and rotatably support the upper and lower ends of the third wrapping roll 119. A gear 85 provided at the lower part of this third wrapping roll 119 is meshed with a gear 86 is rotatably supported on a shaft 87 coupling the arms 84. The gear 86 is further meshed with a gear 89 is rotatably coupled to the above mentioned rotating shaft 82.

The positions of the wrapping rolls 117, 118, and 119 are adjusted by adjusting means 110 of the following description. On the above mentioned rotating shaft 79 is mounted a first can lever 90, which is provided with a cam follower roller 93 in contact with a cam 92 provided on a cam line shaft 91. A vertical shaft 94 is rotatably supported at the middle part of the cam lever 90 and is provided with a second cam lever 95, on one end of which is rotatably supported a cam follower roller 97 for contacting and following a cam 96 on the cam line shaft 91. This cam lever 95 rotatably supports-at its other end another cam follower roller 99 for contacting and following a cam 98 rotatably supported on the above mentioned rotating shaft 79. A spring 100 is connected to the second cam lever 95 to exert a force thereon for holding the rollers 97 and 99 in contact with their respective cams 96 and 98.

A gear 101 rotatable unitarily with the cam 98 is rotatably supported on the rotating shaft 79 and is meshed with a gear 102 provided on a coin setting shaft (not shown).

Below the coin packaging means 122, there is provided a stack lowering rod 115 for receiving each coin stack from the coin stacking device 104 and lowering this stack to a position between the above mentioned wrapping rolls 117, 118, and 119, this stack lowering rod 115 having a seat 116 for bearing the lower surface of the coin stack. The stack lowering rod 115 is adapted to move vertically between the wrapping rolls 117, 118, and 119 in a manner such that the center of the seat 116 is always alined with the center of the space between the wrapping rolls.

The coin packaging machine of the above described mechanical organization including the coin passage device according to this invention operates in the following manner. A description of the operations of the coin passage device and the coin counting means will be omitted since it has been set forth hereinbefore.

The coins C delivered through the coin passage 3 and counted by the counting device are guided by the chute or coin guide structure 102 and stacked as they are accommodated within the coin alinement tube 105. When a predetermined number of coins have been thus stacked within the tube 105, a shutter mechanism (not shown) provided at the lower opening of the alinement tube 105 opens, and the stack of coins is supported at its lower surface on the seat 116 of the stack lowering rod 115 and is lowered into and held in the space between the wrapping rolls 117, 118, and 119 of the coin packaging means 122.

Then, as a consequence of the rotation of the cam 92 of the cam line shaft 91, the first cam lever 90 is rotated by the force of a constant-load spring 80*a* acting on the rotating arm 80. The resulting rotation of the sector gear 78 of the shaft 79 and the sector gear 77 of the shaft 71 is transmitted through the rotating arm 72, the link 125, and the rotating arm 124 to cause the rotating shaft 120 to rotate, whereby the arms 121 and 123 are rotated. Furthermore, the rotating arms 73 and 74 also rotate, and the rotation of the rotating arm 80, the link 81, and the rotating arm 83 causes the arms 84 to rotate, whereby the wrapping rolls 117, 118, and 119 are moved in unison toward the center of the space therebetween thereby to clamp the coin stack therebetween. During this operation since the wrapping rolls 118 and 119 are being rotated by the gears 75 and 85, the coin stack is rotated.

At this time, the leading end of the wrapping paper (not shown) is positioned between a drive roll 107 of a wrapping paper tensioning mechanism 106 and an idler roll 108 by the preceding wrapping operation. Then, when the rolls 118 and 119 rotate with meshed gears, the drive roll 107 is simultaneously rotated, and the idler roll 108 presses against the drive roll 107. As a result, the wrapping paper is abruptly pulled in and tensioned and is cut to a predetermined length by a cutter blade. Furthermore, the leading end of this piece of wrapping paper thus cut is drawn in between the wrapping roll 117 and the coin stack being clamped and rotated by the wrapping rolls 117, 118, and 119, and this piece of wrapping paper is wrapped around the cylindrical surface of the coin stack.

Immediately thereafter, a pair of crimping hooks (not shown) are operated by power transmitted from the cam line shaft 91 to fold crimp the lateral edges of the wrapping paper thus wrapped and projecting outward beyond the upper and lower ends of the coin stack, whereby the peripheries of the two end faces of the wrapped coin stack are secured in a fold crimped state.

Upon completion of the coin wrapping operation as described above, the crimping hooks are driven by the cam line shaft 91 to retract, and, further, the first cam lever 90 is rotated by the cam 92. The rotation of the rotating shaft 79 is transmitted through the sector gears 78 and 77 to actuate the rotating arm 72, the link 125, the rotating arm 124, and the arms 121 and 123. As a result of these movements, the movements of the rotating arms 73 and 74, and the movements of the rotating arm 80, the link 81, the rotating arm 83, and the arms 84, the three wrapping rolls 117, 118, and 118 are moved outwardly thereby to release the wrapped coin stack from its clamped state.

Furthermore, simultaneously with the setting of the width of the coin passage 3, the cam 135 is interrelatedly rotated, and the roller 134 of the adjusting lever 128 on which the force of the spring 133 is acting is caused by the cam 135 to advance and retract. The extension arms 126 and 127 rotate about the pin joints **129*a* and 129*b* as pivotal centers on the adjusting lever 128. The rotation of the arms 114 causes rotation of the divisional slats 112, whereby the coin alinement tube 105 is so adjusted that its inner diameter is in accordance with the diameter of the kind of coin to be stacked and so that its centerline remains in registry with the centerline of the coin passage 3**.

Thus, the inner diameter of the coin alinement tube 105 is varied which its center is caused to coincide with the center of the coin passage 3. Furthermore, the setting of the wrapping rolls 117, 118, and 119 in accordance with the diameter of the coin to be processed is carried out by turning a setting shaft, whereupon the meshed gears 102 and 101 rotate to rotate the cam 98. Then, since the roller 93 of the first cam lever 90 is in contact with the maximum-radius cam surface **92*a* of the cam 92, the second cam lever 95 is pulled by the spring 100, whereby the roller 97 of this cam lever 95 contacts an intermediate-radius cam surface 96*a* of the cam 96 and, moreover, assumes a state wherein it is not contacting the cam 98. That is, the three wrapping rolls 117, 118, and 119** are in their positions of maximum separation from each other or maximum opening state.

As a result of the rotation of the cam line shaft 91, the cams 92 and 96 rotate, and, when the roller 93 of the first cam lever 90 separates from the maximum-radius cam surface **92*a* of the cam 92, the roller 97 of the second cam lever 95 contacts the intermediate-radius cam surface 96*a* of the cam 96. The second cam lever 95 is pulled by the spring 100, whereby the roller 99 contacts the cam 98. This second cam lever 95 rotates through a specific angle about the rotating shaft 79, and the magnitude of this angular displacement is governed by the displacement of the second cam lever contacting the cam surface of the cam 98. The sector gear 78 provided on the rotating shaft 79 is also rotated through a specific angle by the constant-load spring 80*a*. By this time, the rotation of the rotating arm 80 is transmitted through the link 81 and the rotating arm 83 to rotate also the rotating shaft 82. Accordingly, the arms 84 rotate, and the wrapping roll 119** moves one step toward the center of the wrapping space between the wrapping rolls.

As a result of the above described interrelated operation, the wrapping rolls 117 and 118 are also moved one step toward the wrapping center.

In this manner, the wrapping rolls 117, 118 and 119 all move one step toward the wrapping center, the amount of this movement being governed by the cam 98. The wrapping center between the three wrapping rolls 117, 118, and 119 is continually in concident registry with the center of the coin alinement tube 105. Therefore, the wrapping center of the wrapping rolls 117, 118, and 119, the center of the alinement tube 105, and the center of the coin passage 3 are always in coincident registry irrespective of the diameter of the coins being processed.

In the instant example, the inner diameter of the coin alinement tube 105 is adjustable about its stationary centerline, and, furthermore, the wrapping rolls 117, 118, and 119 are adapted to advance and retract toward and from the wrapping center in the space therebetween. These constructions are not so limited, however, it being possible to provide means for selecting different coin alinement tubes 105 in accordance with the diameter of the coins to be processed. More specifically, for example, it is possible to provide a tube selection device comprising a rotary support table of annular shape rotatably supported above the coin wrapping device and coin alinement tubes supported on the support table and having respectively different inner diameters corresponding to different kinds of coins, the center of each selected tube being positioned to register with the wrapping center between the wrapping rolls 117, 118, and 119 when the rotary support table is revolved to bring the selected tube above the wrapping rolls.

Furthermore, it is also possible to provide a tube selection device comprising a moving support structure and coin alinement tubes supported on the support structure and having respectively different inner diameters corresponding to different kinds of coins, the support structure being adapted to undergo reciprocating movement to permit selective positioning of each alinement tube in centerline registry with the wrapping center of the wrapping rolls 117, 118, and 119.

In addition, while the instant example has been described with respect to a construction for manual operation of the shaft for setting the cams 17, 135, and 98, it is also possible to accomplish the same control setting by means of an electric motor and control switch means.

By the above described combination of the coin passage 3, the coin stacking mechanism 104, and the coin wrapping device 122, wherein the centers of these devices are always maintained in mutual registry irrespective of the diameter of the coins being processed, the coins being processed are caused to travel always along a constant path without lateral deviation. Accordingly, the coins are processed accurately and smoothly.

More specifically, the coins delivered through the coin passage 3 and counted by the counting means can be positively and accurately stacked in the succeeding coin stacking mechanism 104 without end-on piling or jamming. Furthermore, the coins stacked in the coin stacking mechanism are guided as a neat stack into the space between the wrapping rolls, and the centerline of this coin stack thus placed is coincident with the wrapping centerline of the wrapping rolls as they converge and clamp the coin stack therebetween. Accordingly, the neat, properly alined state of the stacked coins does not become unstable and is not disturbed when being thus guided into position and being thus clamped between the wrapping rolls. Moreover, the movements of the wrapping rolls are set in accordance with the diameter of the stacked coins.

As a result, appropriate frictional and pressing forces are constantly applied to the coin stack, whereby misfunctioning such as collapsing of the coin stack and displacement and wedging of coins between the stack and the wrapping rolls are prevented. Accordingly, these are afforded desirable results such as prolonged service life of the wrapping rolls, effective coin wrapping performance, and smooth overall operation.

As conducive to a full understanding of the invention in a further embodiment thereof, a known device for adjusting the width of the coin passage 3 will first be briefly described with reference to FIGS. 9 and 10.

Figure 9:
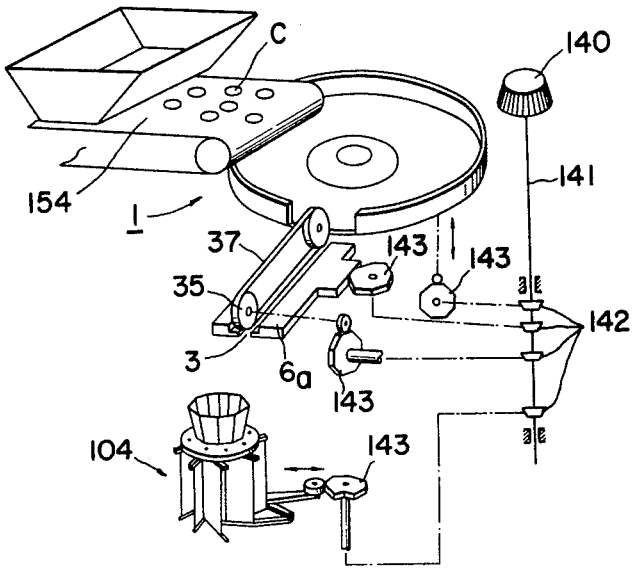
FIG. 9 is a diagrammatic perspective view showing certain parts of a known coin handling machine.
Figure 10:
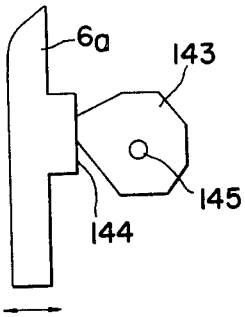
FIG. 10 is a plan view on an enlarged scale of a perimeter edge member and a rotatable cam plate for adjusting the position of the perimeter edge member.

In a known coin processing machine such as, for example, a machine for wrapping different kinds of coins in stacks, each stack being of one kind of coin, as partly shown in the diagrammatic view in FIG. 9, bevel gears 142 are mounted on a rotatable shaft 141 which can be adjustably rotated by a knob 140 for selection of kind of coin. Through one of these gears 142, a polygonal cam 143 for adjusting the width of the coin passage 3 is actuated thereby to adjust the coin passage width by selecting the state of contact between this cam 143 and a passage width adjusting plate 6*a*.

In this known mechanism, the adjusting plate 6*a* has a contact face 144 and is adapted to be actuated directly by the cam 143 contacting and acting on the contact face 144. However, as indicated in FIG. 10, the line of action of the force acting between the cam surface and the contact surface 144 of the plate 6*a* does not pass through the cam shaft 145, that is, the axis of rotation of the cam 143. For this reason, there is the possibility of the adjusting plate 6*a* not being held positively and accurately in its intended proper position. Particularly in the case where the pressing force of the adjusting plate 6*a* against the cam surface is great, this cam 143 may be forced to rotate out of proper angular setting. This difficulty has been overcome by this invention in one embodiment thereof as described below with reference to FIGS. 11 and 12.

Figure 11:
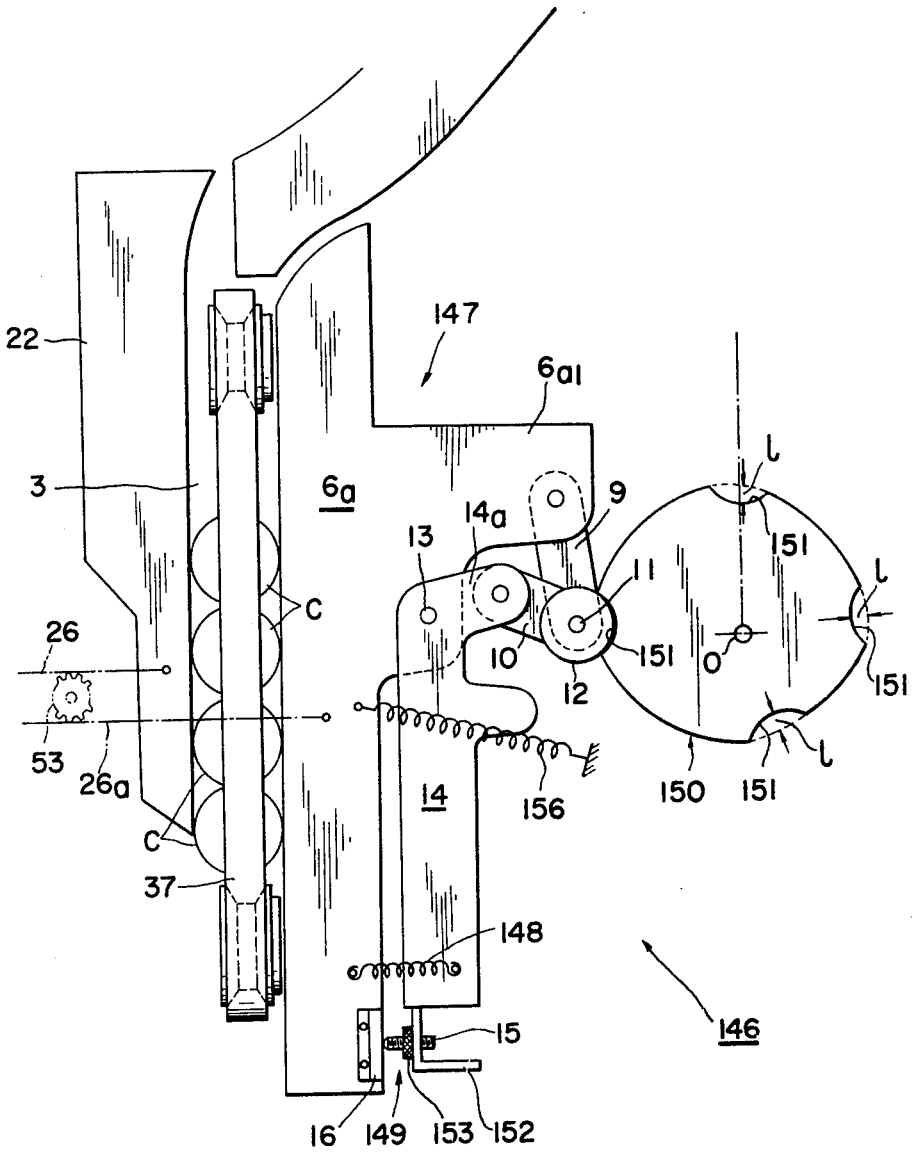
FIG. 11 is a plan view showing side perimeter edge members and a mechanism for adjusting the positions thereof including a novel cam plate of a coin passage device of the invention.
Figure 12:
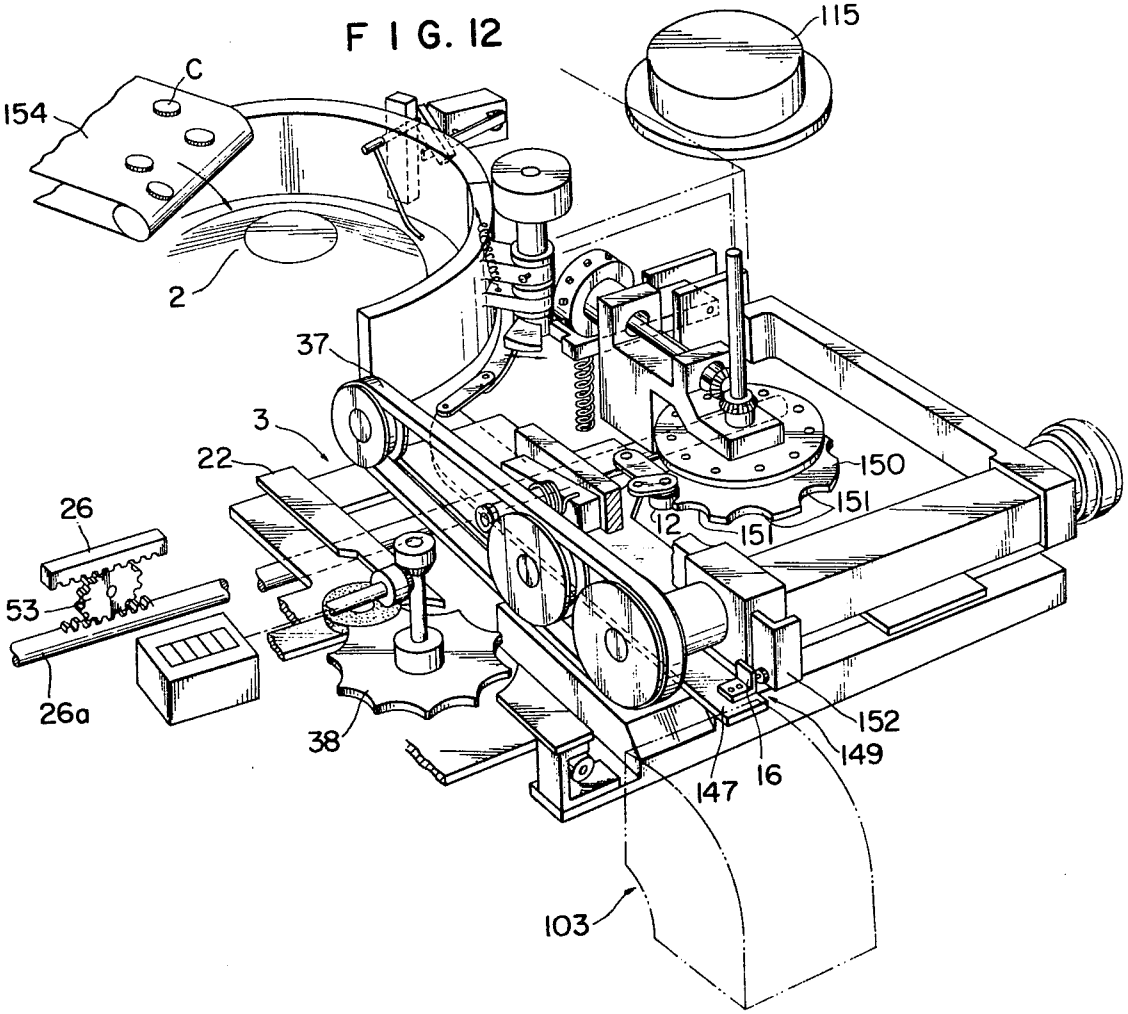
FIG. 12 is a perspective view of a coin handling machine in which the coin passage device shown in FIG. 11 is incorporated.

Referring to FIG. 11, there is shown therein a coin passage width adjusting device 146 having a coin passage 3 the width of which is set in accordance with the diameter of the coins C propelled therealong by an endless propelling belt 37 as described hereinbefore, the passage 3 being formed between perimeter plates 22 and 147. As in the preceding examples, links 9 and 10 are respectively pin connected on their one side to the first perimeter edge member 6*a* and the lever 14 and are commonly pin connected at their other ends, at which the cam follower roller 12 is rotatably supported.

In accordance with the instant embodiment of this invention, this cam follower roller 12 is actuated by and operates cooperatively with a novel cam plate 150 rotatable by suitable means such as a knob 155 for selection of the kind of coin. The cam plate 150 has around the periphery thereof a number of arcuate recess 151 into each of which the roller 12 can firmly fit. This cam plate 150 may be considered to be an eccentric disk. The number of the arcuate recesses 151 conforms to the number of kinds of coins the machine is to process, and all recesses are of the same depth 1 at their bottoms. The radius vector joining the bottom of each recess 151 and the center of rotation of the cam plate 150 is such that, when the roller 12 fits into that recess 151, the width of the coin passage 3 will be set to accommodate coins of the kind corresponding to that recess 151.

In the operation of this coin passage device, the above mentioned knob 155 is turned to set the device for a selected kind of coin, whereupon the cam plate 150 is rotated to an angular position where the recess 151 corresponding to that kind of coin confronts the roller 12, which thereupon is forced by the force of a spring 156 (FIG. 11) to fit into that recess 151. That is, roller 12 is displaced by the action of the cam plate 150 by a specific distance to move the first perimeter edge plate 6*a* and also the second perimeter edge plate 22 through the intercoupling provided by the pinion and rack mechanism 53, 26, 26*a*. In this action, a displacement corresponding to one half of the displacement of the roller 12 is imparted to the perimeter edge plates 6*a* and 22, and the sum of the displacements of these plates 6*a* and 22 is the change of width of the coin passage 3.

Fine adjustments of the width of the coin passage 3 are made by means of the adjusting mechanism 149 comprising a bracket 152, an adjusting screw rod or bolt 15, a nut 153 for adjustment locking, and an engagement 16 as described hereinbefore.

A unique feature of the coin passage width adjusting device 146 of the instant example is that, when the coin passage width is to be reset to coins of a different kind, the roller 12 fits into the proper recess 151 of the cam plate 150, and, moreover, the contact force acting between the roller 12 and the cam plate 150 at this recess 151 is caused to pass through the axis of rotation of the cam plate 150. Accordingly, the perimeter edge plates 6*a* and 22, which define the width of the passage 3, are positively and accurately held in their set position, and there is little possibility of their state being affected by disturbances such as vibration arising during driving of the coin processing machine.

Furthermore, even in the unlikely event that coins become clogged within the coin passage 3, it is possible to stop the coin processing machine and to open manually the perimeter edge plates 6*a* and 22. More specifically, by pulling the lever 14 for adjusting the passage width upward and toward the right as viewed in FIG. 11, the link 10 is placed in a folded state relative to the projecting part 14*a* of the lever 14 since the roller 12 is in a fixed position, and thus lever 14 can be inclined. Consequently, by displacing the first perimeter edge plate 6*a* coupled by a spring 148 to this lever 14, the coin passage 3 can bbe widened.

Conversely, when the coin passage width is to be changed by means of the cam plate 150, the link 10 does not assume the above mentioned folded state since the spring 148 is coupling the perimeter edge plate 6*a* and the lever 14 with great force, and the entire adjustment plate 147 becomes a unitarily rigid structure and is pressed and displaced by the roller 12.

It is to be understood that the perimeter edge plate 22 and the adjusting plate 147, that is, the perimeter edge plate 6*a* can move only in the transverse direction relative to the centerline of the coin passage 3 since the racks 26 and 26a are caused to slide along guide means such as guide grooves (not shown).

I claim:

1. In a coin counting machine having a rotating turntable onto which coins to be counted are supplied, a coin passage device adjacent said turntable at a position for receiving coins from said turntable due to centrifugal force acting on the coins on said turntable for aligning the successively fed coins, a coin propelling means provided on said coin passage device for forcibly propelling the coins introduced onto said coin passage therethrough, a coin counting device provided along said coin passage for counting the number of coins passing through said coin passage, and a coin guide structure provided adjacent the outlet end of said coin passage device for guiding the coins discharged from said coin passage device one by one, the improvement wherein said coin passage device comprises first and second side perimeter edge member each having means defining a vertical side wall and a horizontal coin edge supporting surface, the spaced side walls defining opposite side walls of the coin passage, at least the means of said perimeter edge members defining said vertical side walls being adjustably movable toward and away from each other equal distances in accordance with the diameter of the coins to be counted thereby to adjust the transverse width between the side walls of the coin passage to a dimension slightly larger than the coins to be counted, said adjusting movement being without causing a shift of the longitudinal centerline of said coin passage and position adjusting means connected to said perimeter edge members for adjustably moving at least said means defining the vertical side walls on said first and second perimeter edge members, whereby the coins are always propelled along said centerline of the coin passage irrespective of the kind of coins to be counted; and said coin counting device being fixedly connected with said second side perimeter edge member so as to be moved together with said member thereby to always maintain said coin counting device at a position appropriate for the coin counting irrespective of the diameter of the coins to be counted; said coin propelling means being at a position coincident with said centerline of the coin passage; and said guide structure comprises side wall members corresponding respectively to said first and second side perimeter edge members and means for adjustably moving said side wall members equal distances with respect to the centerline of the coin guide structure for positioning said side wall members in positions corresponding to the diameter of the coins to be processed, and the centerline of said guide structure being aligned with the centerline of said coin passage device, whereby said guide structure is always positioned to receive coins irrespective of the diameter of the coins to be counted.

2. A coin passage device as claimed in claim 1 in which said position adjusting means comprises: a roller rotatably supported on one part of one of the perimeter edge members; a cam plate having a center of rotation and having around the peripheral part thereof a plurality of concavely arcuate recesses having a curvature corresponding to the peripheral curvature of said roller and each engageable by said roller in rotation blocking engagement therewith, the distances respectively between the deepest parts of said recesses and the cam center of rotation being respectively of different magnitudes for adjusting the coin passage width for respective kinds of coins; cam rotating means for rotating the cam plate for adjustment of the positions of said perimeter edge members; and elastic means connected to said roller for urging the roller against the cam plate.

3. In a coin counting machine having a rotating turntable onto which coins to be counted are supplied, a coin passage device adjacent said turntable at a position for receiving coins from said turntable due to centrifugal force acting on the coins on said turntable for aligning the successively fed coins, a coin propelling means provided on said coin passage device for forcibly propelling the coins introduced onto said coin passage therethrough, a coin counting device provided along said coin passage for counting the number of coins passing through said coin passage, a coin stacking device for stacking the coins counted by said coin counting device, a coin guide structure provided adjacent the outlet end of said coin passage device for guiding the counted coins one by one into said coin stacking device, and a coin packaging device with a plurality of wrapping rolls for surrounding a coin stack introduced among said wrapping rolls from said coin stacking device and adapted to be adjusted so as to be accommodated to the diameter of the coins to be processed, the improvement wherein said coin passage device comprises first and second side perimeter edge members each having means defining a vertical side wall and a horizontal coin edge supporting surface, the spaced side walls defining opposite side walls of the coin passage, at least said means of said perimeter edge members defining said vertical side walls being adjustably movable toward and away from each other equal distances in accordance with the diameter of the coins to be counted thereby to adjust the transverse width between the side walls of the coin passage to a dimension slightly larger than the coins to be counted, said adjusting movement being without causing a shift of the longitudinal centerline of said coin passage and position adjusting means connected to said perimeter edge members for adjustably moving at least said means defining said vertical side walls on said first and second perimeter edge members, whereby the coins are always propelled along said centerline of the coin passage irrespective of the kind of coins to be counted; said coin counting device being fixedly connected with said second side perimeter edge member so as to be moved together with said member, whereby said coin counting device is always maintained at a position appropriate for the coin counting irrespective of the diameter of the coins to be counted; said coin propelling means being at a position coincident with said centerline of the coin passage; the stack-centerline of said coin stacking device and the center of the space among said wrapping rolls respectively being aligned with the centerline of the coin passage, and said guide structure comprises side wall members corresponding respectively to said first and second side perimeter edge members, and means for adjustably moving said side wall members equal distances with respect to the centerline of the coin guide structure so that said members are always set in positions corresponding to the diameter of the coins to be processed and the centerline of said guide structure being aligned with the centerline of said coin passage device, whereby the coin guide structure, the coin stacking device and the coin packaging device always being at appropriate positions irrespective of the diameter of the coins to be counted.

* * * * *